United States Patent [19]

Walker

[11] 4,103,599

[45] Aug. 1, 1978

[54] METHOD AND MEANS FOR IMPROVED AIR DISTRIBUTION

[75] Inventor: Louis Walker, Griffith, Ind.

[73] Assignees: Armand Ascani, Park Forest; Louis J. Piattoni, Chicago Heights, both of Ill. ; part interest to each

[21] Appl. No.: 757,831

[22] Filed: Jan. 10, 1977

Related U.S. Application Data

[63] Continuation of Ser. No. 607,119, Aug. 25, 1975, abandoned.

[51] Int. Cl.[2] ..... F24F 13/08

[52] U.S. Cl. ..... 98/33 A; 98/40 D; 236/49; 165/22

[58] Field of Search ..... 98/33 A, 40 D; 236/49; 165/22

[56] References Cited

U.S. PATENT DOCUMENTS

| | | | |
|---|---|---|---|
| 2,235,607 | 3/1941 | Carraway | 98/33 A |
| 2,455,250 | 11/1948 | Hallinan | 98/33 A |
| 2,804,816 | 9/1957 | Hoyer | 98/33 A |
| 2,806,675 | 9/1957 | Conradi | 165/22 |

*Primary Examiner*—John J. Camby
*Assistant Examiner*—Henry C. Yuen
*Attorney, Agent, or Firm*—Walter Leuca

[57] ABSTRACT

A method and means for providing an improved air distribution for a plurality of rooms insuring that rooms further along the main duct line from the blower source are adequately provided with air. This is accomplished by providing a counterweighted closure for the ceiling plenum return outlet of each of a plurality of air control boxes. Each of said closures is counterweighted to provide a back pressure to the air in the main duct when the main damper of the air control box is closed, equivalent to the back pressure provided by the resistance to air flow through the control box, diffuser outlets of each control box and the static pressure present in the rooms supplied by the diffuser outlets when the main damper of the control box is open.

7 Claims, 4 Drawing Figures

METHOD AND MEANS FOR IMPROVED AIR DISTRIBUTION

This is a continuation, of application Ser. No. 607,119, filed Aug. 25, 1975 now abandoned.

BACKGROUND OF THE INVENTION

1. Field of the Invention

This invention relates generally to an air distribution system and more particularly to improvements in air control boxes for improved distribution of air to a plurality of rooms.

2. Description of the Prior Art

In supplying temperature treated air to a plurality of rooms in a building, ductwork is provided for directing the treated air from an air treating station such as an air conditioner or a heating unit through ductwork and diffusers which connect the ductwork and the rooms to be supplied with air. Interposed between the duct line and the diffusers are thermostat controlled dampers in boxes which control the flow of air from the duct line to the diffusers which connect several adjacent rooms. Conventionally, one of these rooms contains a thermostat which operates a damper in the control box servicing these several rooms. The thermostat will cause the damper to open allowing temperature treated air to flow through the control boxes into these several rooms until the thermostat is satisfied which will thereupon close the damper stopping the flow of air therethrough with the exception of a small amount allowed to go through the control box through a manually set partially open bypass damper to provide air for circulation purposes.

In the prior art control boxes utilized in such a system, the main damper closes when the thermostat in one of these several adjacent rooms is satisfied. The air supplied thereto from the duct line is then shunted in the air control box through an opening therein to be returned in the system through the ceiling plenum for re-circulation through the air treating station.

The problem of the prior art above described that this invention is directed to is that experienced when the main damper of one or more air control boxes of a plurality of control boxes is closed. The air supplying the closed control box will be shunted through the opening in the control box into the ceiling plenum for re-circulation. An excessive amount of conditioned air escapes through the control boxes nearer the air treating station with the result that air remaining in the duct line to supply other control boxes further down the line will be insufficient. Consequently, the rooms further along the duct line are inadequately provided with air and poor temperature control is obtained.

SUMMARY OF THE INVENTION

Accordingly, to overcome this problem of the prior art, I provide a damper control for the ceiling plenum return outlet of each control box which provides a back pressure to the air flowing therethrough when the main damper of the control box is closed. The back pressure obtained is equivalent to the back pressure provided by the diffuser outlets of each control box and the static pressure present in the rooms supplied by the diffuser outlets when the main damper of the control box is open. Since the back pressure due to resistance to air flow offered by the air control box, diffuser ducts and the static pressure of the rooms supplied by the diffuser are determinable and substantially stable for each air control box station, I provide a movable closure member in the return outlet of the control box which has an adjustably positioned counterweight so that when the main damper of the control box is closed, and the air in the control box is shunted through the return outlet for recirculation, the closure member closing the return outlet is opened against the counterweight which offers a back pressure equivalent to the back pressure offered by the control box, diffuser ducts and the static pressure in the rooms when the main damper of the control box is open. The result obtained is that regardless whether the main damper of any control box is open or closed, the air flow in the main duct line will not vary and the control boxes further down the duct line will be adequately supplied with air.

The foregoing considerations set forth the more important objects of this invention. Other objects and advantages will become apparent upon a study of the following disclosure when considered in conjunction with the accompanying drawings.

DESCRIPTION OF THE PREFERRED EMBODIMENT

Figure 1:
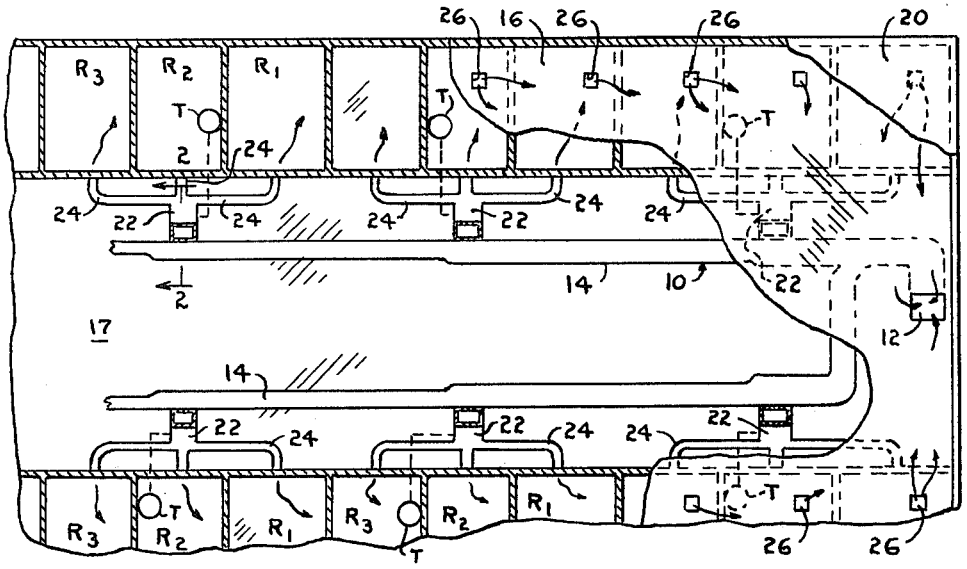
FIG. 1 is a top view of the control boxes incorporating my invention illustrating their position in a ductwork system arranged to provide temperature-conditioned air to a multiplicity of rooms along a main duct line.

With reference now to the drawings, my invention comprises an air distribution system for a plurality of rooms. Numeral 10 designates generally the system of my invention. It comprises an air treating station 12 which generally is a temperature treating unit such as a combination heater-cooler unit provided with a blower for moving the treated air through duct line 14 supported above the ceiling 16 of corridor 17. Buildings having rooms illustrated by the plan of FIG. 1 are conventionally constructed with a space between ceiling 16 and floor 20 of the next story which is sufficiently contained to serve as a plenum for the air return in the system. A plurality of air control boxes 22 connect the main duct line 14 at one end thereof communicating therewith and with air diffuser lines 24 at the other end thereof. As illustrated, for example in FIG. 1, three air diffuser lines 24 are connected to the exit end of each of air control boxes 22, and each air diffuser line 24 outlets into one of three adjacent rooms, R1, R2, R3. Appropriately located in the ceiling of each of rooms R1, R2, R3 is a return screen 26 through which air which enters into each room through diffuser lines 24, exits or vents to the ceiling plenum 18 for return to air treating station 12 for recirculation. Each air control box 22 along duct line 14 is provided with a main damper 28 linked to a motor drive (not shown) to open and close the passage therethrough. The damper motor drive is controlled by a thermostat control T in one of each set of rooms, R1, R2, R3. Provided in each air control box 22 is a return outlet 30 communicating the portion of control box 22 between main duct line 14 and main damper 28 with the ceiling plenum 18 to re-circulate the air through the temperature treating station 12 and main duct line 14. Also provided in control box 22 is an air filter screen 31 conveniently interposed between duct line 14 and return outlet 30. When main damper 28 is closed, a small amount of air is allowed to go through the control box by providing a partially opened by-pass gate 29 to allow just enough air to enter the rooms R1, R2 and R3 for circulation purposes. The amount of air by-passed through gate 29 is inadequate to affect the operation of this invention. Since air in the air control box 22 communicating with the main duct line 14 nearest the blower of the temperature treating station unit 12, is at a higher pressure than the air at the air control boxes further away along the duct line 14, the air pressure as well as air volume at these control boxes will be less. Accordingly, duct line 14 is formed with smaller cross section areas further down the line to compensate for the loss of pressure and volume. These factors may be pre-determined and the duct line designed to provide adequate pressure and volume for any control box. However, since the opening and closing of any control boxes 22, or a combination of them, along air duct line 14 cannot be pre-determined, a variable air condition can exist which would result in an uneven distribution of air to the rooms R. For example, since air duct line 14, air control boxes 22, diffuser conduits 24 and rooms R1, R2, R3 are fixed structures, air flow factors determining the size and the length of sections of duct line 14 may be pre-determined when the main dampers of each of the air control boxes are open. However, this situation in actual practice does not occur because of the several thermostats T which introduce the variables.

If the thermostat T in one of the rooms served by an air control box nearer in position on air duct line 14 to the blower of air treating station 12, operates to close main damper 28 of one or more air control boxes 22, the air therein will escape unimpeded through outlet 30 to ceiling plenum 18 which action will result in a drop in air pressure in duct 14 further down the line which cannot be provided for in the design of the fixed structure. This will result in the provision of less air to the rooms further away from the air temperature station whereby poor temperature control is obtained in these rooms.

Figure 2:
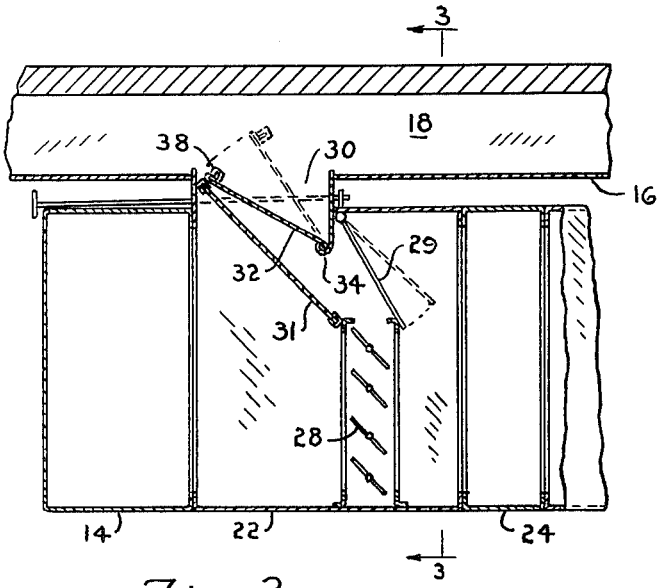
FIG. 2 is a side view of the control box longitudinally sectioned along line 2—2 of FIG. 1 showing the counterweighted closure member of my invention in the return opening of the control box.
Figure 3:
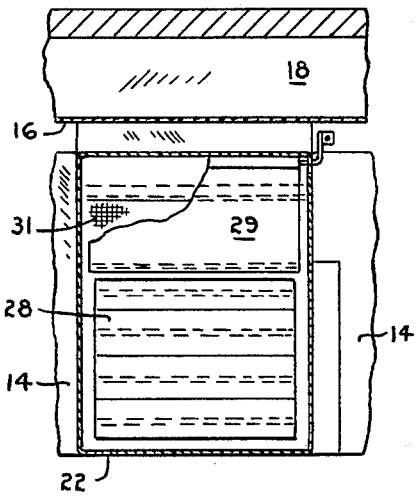
FIG. 3 is a cross sectioned view of the control box taken along lines 3—3 of FIG. 2.
Figure 4:
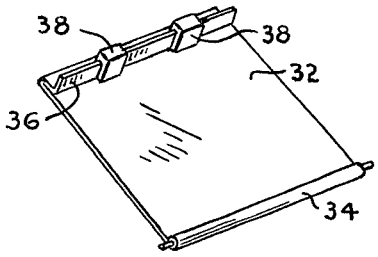
FIG. 4 is a perspective detail of the closure member adapted with counterweights.

I provide in each return outlet 30 of each air control box 22 a closure member 32 hingedly connected at a side thereof as at 34 so that closure member 32 may open and close the passage of return outlet 30 when main damper 28 of control box 22 is closed and opened respectively. Closure member 32 of my invention is a sheet metal plate formed with an upstanding lip 36 at the side opposite the hinged side, on which is mounted one or more counterweights 38. I provide counterweights which are removably mounted on lip 36 and fastened thereon by friction hold or by any other convenient manner to obtain the result desired, that is to provide impedence to the air flow through return outlet 30. I illustrate in FIG. 4, a method of providing removable counterweights, such as by forming closure member 32 with an upstanding edge or lip 36 at the side thereof distal from the hinge side 34, adapted to carry thereon bifurcated weight members 38.

For each control box 22, I determine the resistance to air flow therethrough when the main dampers 28 of all the control boxes 22 are in their open position by determining the static air pressure in the air control box at a position in advance of the dampers. I then close main dampers 28 of each control box 22 to allow closure member 32 to open in the return outlet 30 and then position weight members 38 on upstanding lip 36 so that closure member 32 partially closes until the air pressure as determined by reading the gauge in advance of damper 28 is the same as when damper 28 is in full open position. The counterweight members 38 are then fixed on that closure member 32 by clamping the bifurcated end onto lip 36. This procedure is followed on every control box 22 along main duct 14 servicing rooms R in the building. Therefore, by providing a counterweighted closure member 32 in the return outlet 30 of each air control box 22 which are individually counterweighted to close each return outlet 30 in air control boxes 22 sufficiently to offer the same impedence to the air flow therethrough regardless whether main dampers 28 of boxes 22 are open or closed, air pressure and air flow through main duct 14 will remain stable thereby eliminating the variables introduced by the individual operation of the thermostats T and allowing the engineering design of the ductwork to control the distribution of the air. This will result in an air distribution system wherein all the air control boxes will be adequately supplied with air regardless of its open or closed condition and its distance from the blower unit.

What I claim is:

1. An air distribution apparatus for a plurality of rooms contained within an enclosed space wherein the ceiling of said plurality of rooms is spaced from the ceiling of said enclosed space, comprising: a main duct line extending the length of said plurality of rooms; a plurality of air control boxes extending from said main duct line and communicating therewith; room duct lines extending from each of said control boxes communicating said control boxes and said rooms; each of said air control boxes having an opening communicating said air control box with said space between said ceiling of said enclosed space and said ceiling of said room; a damper in each of said control boxes operable to control air flow through said air control boxes from said main duct line to said room duct lines; an air blower source having an outlet and an inlet, said outlet communicating with said main duct line, and said inlet communicating with said space between said ceiling of said enclosed space and said ceiling of said rooms; a pivoted closure means in said opening in each of said air control boxes, said pivoted closure means having counter-weight means and being weighted to progressively close each of said openings as said damper progressively opens, and to progressively open said opening as said damper progressively closes said air control boxes.

2. The air distributor apparatus of claim 1 wherein said pivoted closure means is further characterized as being weighted to restrict the opening in each of said control boxes with a bias against the flow of air therethrough equal to the total friction and static forces to the air flow into said room when said damper in said control boxes is open.

3. The air distribution apparatus of claim 1 wherein said pivoted closure means is further characterized as being weighted to provide a back pressure to the air in said main duct line when said damper in said control box is closed equal to the back pressure in said main duct line when said damper of said control box is open.

4. In an air distribution system for a plurality of rooms wherein a duct line channels air from a blower source to said rooms and wherein a plurality of air control boxes are interposed between said duct line and said rooms, and wherein each of said air control boxes having an opening to communicate said duct line and at least one of said plurality of rooms, wherein means operate a damper in said opening of said control box to control air flow through said air control box from said duct line to said rooms, and further wherein a return plenum opening is provided for each of said air control boxes communicating said air control boxes and said blower source for recirculating the air when said damper in said opening of said control box is closed, the improvement therewith comprising: a pivoted closure means in each of said return plenum openings having counterweight means and weighted to progressively close each of said return plenum openings as said damper in said opening of said control box progressively opens, and to progressively open said return plenum opening as said damper progressively closes said opening in said control box.

5. In an air distribution system of claim 4 wherein said closure means is further characterized as being weighted to restrict said return plenum opening with a bias against the flow of air therethrough equal to the total friction and static forces to air flow into said rooms when said damper in said control box is open.

6. In an air distribution system for a plurality of rooms wherein a duct line channels conditioned air from a blower source to said rooms and wherein a plurality of air control boxes are interposed between said duct line and said rooms, and wherein each of said air control boxes communicates said duct line and at least one of said plurality of rooms wherein a thermostat therein operates a damper in said control box to control air flow through said air control box from said duct line to said rooms, and further wherein a return plenum opening is provided for each of said air control boxes communicating said air control boxes and said blower source for recirculating the air when said damper in said control box is closed, the improvement comprising: a closure means having counter weight means in each of said return plenum openings weighted to pivotally close said return plenum opening of said air control box with a force equal to the total friction and static forces to air flow into said rooms when said damper in said control box is open.

7. In an air distribution system for a plurality of rooms wherein a duct line channels conditioned air from a blower source to said rooms and wherein a plurality of air control boxes are interposed between said duct line and said rooms, and wherein each of said air control boxes communicates said duct line and at least one of said plurality of rooms wherein a thermostat therein operates a damper in said control box to control air flow through said air control box from said duct line to said rooms, and further wherein a return plenum opening is provided for each of said air control boxes communicating said air control boxes and said blower source for recirculating the air when said damper in said control box is closed, the improvement therewith comprising: a closure member hinged to pivotally close said return plenum opening in each control box, a counterweight on said closure member to provide a pivot bias restricting said opening against the flow of air therethrough when said damper of said control box is closed, said opening restriction impeding the air flow through said return plenum opening, said impedence to air flow providing a back pressure to air in said duct line equal to the back pressure present in said duct line when said damper of said control box is open.

* * * * *